US005533923A

United States Patent [19]

Shamouilian et al.

[11] Patent Number: 5,533,923

[45] Date of Patent: Jul. 9, 1996

[54] CHEMICAL-MECHANICAL POLISHING PAD PROVIDING POLISHING UNFORMITY

[75] Inventors: Shamouil Shamouilian, San Jose; Daniel O. Clark, Pleasanton, both of Calif.

[73] Assignee: Applied Materials, Inc., Santa Clara, Calif.

[21] Appl. No.: 419,573

[22] Filed: Apr. 10, 1995

[51] Int. Cl.[6] ..... B24B 1/00; B23D 11/00

[52] U.S. Cl. ..... 451/41; 451/532; 451/36; 451/449

[58] Field of Search ..... 451/41, 285, 287, 451/283, 317, 532, 488, 60, 446, 548, 554, 36, 449

[56] References Cited

U.S. PATENT DOCUMENTS

| | | | |
|---|---|---|---|
| 5,020,283 | 6/1991 | Tuttle | 451/41 |
| 5,177,908 | 1/1993 | Tuttle | 451/41 |
| 5,300,188 | 4/1994 | Tessmer et al. | 451/41 |

*Primary Examiner*—Bruce M. Kisliuk
*Assistant Examiner*—Dona C. Edwards
*Attorney, Agent, or Firm*—Shirley L. Church; Charles S. Guenzer; Robert W. Mulcahy

[57] ABSTRACT

In accordance with the present invention, a polishing pad useful for polishing a semiconductor-comprising substrate is disclosed. The polishing pad is constructed to include conduits which pass through at least a portion of and preferably through the entire thickness of the polishing pad. The conduits, preferably tubulars, are constructed from a first material which is different from a second material used as a support matrix. The conduits are positioned within the support matrix such that the longitudinal centerline of the conduit forms an angle ranging from about 60° to about 120° with the working surface of the polishing pad. In the most preferred embodiment of the present invention, the conduits pass all the way through the thickness of the polishing pad and are sized to permit the flow of polishing slurry, reactive etchant material, heat transfer medium, and/or lubricant from a supply device through the conduits to the working surface of the polishing pad (at least a portion of which is in contact or near contact with the article to be polished).

43 Claims, 3 Drawing Sheets

CHEMICAL-MECHANICAL POLISHING PAD PROVIDING POLISHING UNFORMITY

BACKGROUND OF THE INVENTION

1. Field of the Invention

The present invention pertains to a chemical-mechanical polishing pad structure and composition which enable polishing uniformity. The polishing pad structure provides a means for feeding polishing slurry, reactive etching reagent, heat transfer medium (cooling fluid), lubricant, or combinations thereof to the surface of the polishing pad as well as a means for holding such slurry, etching reagent or other fluid materials upon the pad surface.

2. Brief Description of the Background Art

Chemical-mechanical polishing has been used for more than twenty-five years as a technique for polishing optical lenses and semiconductor wafers. During the past ten years, chemical-mechanical polishing has been developed as a means for planarizing interlevel dielectrics and for removing conductive layers within integrated circuit devices as they are fabricated upon various substrates. In fact, chemical-mechanical polishing is currently viewed by many semiconductor technologists as the most promising method for the global planarization, and as necessary to enable the fabrication of integrated circuit devices having dimensions below 0.35 μm. Research is now targeted on ways to better understand and control the subtle interactions between the surface to be planarized, the polishing pad, and the chemical composition used to aid in the polishing (typically a slurry containing abrasive or reactive particulates).

The present invention pertains to a polishing pad structure and composition which enables polishing uniformity. As a backdrop for the significance of the present invention, it is helpful to review background art pertaining to polishing pads of the kind generally used within the integrated circuit fabrication industry.

U.S. Pat. No. 4,138,228 to Hartfelt et al., issued Feb. 6, 1979, describes a polishing pad consisting essentially of platelets of a polymer and an inorganic polishing abrasive of an average particle size of less than 10 microns, wherein the platelets form a microporous sponge-like polymer matrix which is liquid absorbing, and essentially all of the abrasive particles are unencapsulated and carried upon (affixed to) the surfaces of the platelets. Preferably the polymer is bonded weakly to the polishing abrasives, whereby a controlled release of polishing abrasive from the polymer occurs during polishing.

U.S. Pat. No. 4,728,552 to Wilmer Jensen, Jr., issued Mar. 1, 1988, discloses a poromeric polishing pad comprising a felt sheet of fibers impregnated with a microporous elastomer. The polishing pad is constructed such that the majority of fiber ends adjacent to the work surface of the pad form an angle of between about 45° and about 135° with respect to the surface to be polished. Preferably the fibers have an orientation substantially perpendicular to the work surface.

U.S. Pat. No. 4,841,680 to Hoffstein et al., issued Jun. 27, 1989, describes a polishing pad material having a cellular polymeric layer (typically a polyurethane elastomer) containing elongated cells (formed within the polyurethane elastomer by the process used to coagulate the elastomer from a solution). The skin of the cellular polymeric layer is removed to expose the elongated cells which are used to hold the slurry on the surface of the polishing pad during polishing operations.

U.S. Pat. No. 4,927,432 to Budinger et al., issued May 22, 1990, discloses a polishing pad material produced by reinforcing a conventional porometric material (such as polyurethane, formalized polyvinyl alcohol, polycarbonate, and polyureas) with a fibrous network such as a felted mat of polyester fibers. The resin is coalesced among the fibers, preferably by heat treatment, to increase porosity and hardness of the polyurethane as well as increasing surface activity of the resin. Photomicrographs of the pad material show the fibers to be generally randomly oriented within the porometric material.

U.S. Pat. No. 5,020,283 to Mark E. Turrle, issued Jun. 4, 1991, describes a polishing pad having a face shaped by a series of voids. The voids are substantially the same size, but the frequency of the voids increases with increasing radial distance from the center of the pad. This void pattern is said to provide a nearly constant surface contact rate at the workpiece surface during polishing. The voids are preferably depressions or grooves, although it is said the voids could be holes extending entirely through the pad. No material or method of construction is called out for the polishing pad; however, based on the drawings, the voids are machined into the surface of the pad.

U.S. Pat. No. 5,212,910 to Breivogel et al., issued May 25, 1993, discloses a composite polishing pad which comprises a first support layer of elastic material (attached to the pad support table), a second and intermediate stiff layer which is segmented into individual sections physically isolated from one another in the lateral dimension, and a third spongy layer optimized for slurry transport. Each segmented section of the second layer is resilient across its width, yet cushioned by the first layer. The physical isolation of each section, combined with the cushioning of the first layer of material is said to create a "bedspring" effect which enables the pad to conform to longitudinal gradations across the surface to be polished. Preferably the first layer is a silicone sponge rubber or foam rubber, the second layer is a composite fiberglass epoxy material, and the third layer composition is not specifically identified other than by the name "SUBA 500" (a product of Rodel, Inc. of Newark, Del.).

U.S. Pat. No. 5,329,734 to Chris C. Yu, issued Jul. 19, 1994, describes a polishing pad having a first region near the edge of the pad and a second region located interior to the first region. The second region has a plurality of openings or a larger average pore size compared to the first region. The openings can be depressions within the surface of the pad or channels which pass completely through the pad. Pores are distinguished from openings because pores are said to be formed during the reaction to produce the polymeric polishing pad material while openings are formed within the pad after the polishing pad material has been formed. The depressions or openings are said to be fabricated using laser ablation or mechanical machining techniques. The polishing pad is fastened to an underlying substrate using an adhesive. Yu describes the openings, which provide slurry-holding voids, as occupying from between about 5 and about 50% of the surface area within the portion of the polishing pad in which such openings are present.

All of the above polishing pads seek to provide a means for holding a polishing compound or slurry uniformly across the surface of the polishing pad. Some of the polishing pads provide fibers or abrasive materials within the pad itself to aid in the polishing operation. The present invention provides a means for holding a slurry uniformly across the surface of a polishing pad, provides the capability for feeding polishing slurry, reactive etchant material, cooling fluid and/or lubricant through the pad to the surface of the article being polished, and may provide the equivalent of fibers which act as abrasive agents, depending on the polishing pad materials of construction.

SUMMARY OF THE INVENTION

In accordance with the present invention, a polishing pad useful for polishing a semiconductor-comprising substrate is constructed to include a plurality of conduits which pass through at least a portion of, and preferably, through the entire thickness of the polishing pad. The conduits are preferably constructed of a material different from the surrounding matrix material which supports them within the polishing pad. Most preferably, the conduits are constructed from a material having adequate spring-like quality to return to their original position after contact with the surface to be polished while having sufficient hardness to be useful in contact abrading of the surface to be polished. The opening of the conduit near the surface of the polishing pad is designed to act as a pocket for holding slurry upon the working surface of the polishing pad. Typically the conduit will be cylindrical in shape, although it need not be, as the ability to transport a fluid through the conduit is enhanced when the conduit is a square. A conduit having an undulating shape, such as a star shape, can be useful in directing the flow of particulate materials. For purposes of discussion herein, the conduit will be described as being cylindrical in shape, i.e., as being a "tubular". This is by way of example and not by way of limitation. The inner diameter (ID) of the tubular near the pad surface is designed to provide a holding pocket adequate to handle the slurry or reactive etchant material to be used during polishing. The matrix material surrounding the tubulars can be rigid or flexible, depending on the surface to be polished and on whether it is desired to have the polishing pad act as a rigid surface against the article to be polished or act as a conformal surface which conforms to minute features on the surface to be polished. In any case, the material surrounding the tubulars holds the tubulars in an essentially erect position so that as the tubulars contact the surface of the article being polished, and do not bend and fold over or lie flat against the polishing pad itself.

In the most preferred embodiment of the present invention, the conduits pass all the way through the thickness of the polishing pad and are sized to permit the flow of polishing slurry, reactive etchant material, heat transfer medium, and/or lubricant from a supply device through the conduits to the working surface of the polishing pad (at least a portion of which is in contact or near contact with the article to be polished). The slurry supply device feeds slurry to the non-working surface of the polishing pad where the slurry contacts and flows through the conduits to the working surface of the polishing pad. Depending on the design of the slurry supply device, the pressure used to supply slurry to the non-working surface of the polishing pad can also be used to apply pressure to non-working surface of the polishing pad, moving the polishing pad surface into closer contact with the surface to be polished. When the polishing pad material surrounding the tubulars is sufficiently flexible, the pressure applied to the nonworking surge of the polishing pad can provide a better conformal contact between the polishing pad and the article's surface topography.

The polishing pad is preferably mounted vertically above the surface of the article to be polished when the tubulars are to be used to feed polishing slurry to the working surface of the polishing pad. This assists in the overall flow characteristics of the slurry through the tubulars and onto the working surface of the polishing pad.

BRIEF DESCRIPTION OF THE DRAWINGS

FIG. 2 illustrates a preferred embodiment of the polishing pad of the present invention. The dimensions in FIG. 2 are not to scale, as the diameter of the tubulars relative to the diameter of the polishing pad is exaggerated for the purpose of illustrating the tubular and the wall of the tubular. FIG. 2A shows the working surface of the polishing pad, while

DETAILED DESCRIPTION OF THE PREFERRED EMBODIMENTS

The present invention pertains to chemical-mechanical polishing (or chemical-mechanical planarization) (CMP) of a semiconductor substrate and device materials upon that substrate. In general, a semiconductor wafer can be polished to remove high topography, surface defects such as crystal lattice damage, scratches, roughness, or embedded particles of dirt or dust. Frequently the polishing process involves the introduction of a chemical slurry or reactive etchant material to facilitate more rapid polishing rates.

The CMP process involves holding and rotating a thin flat substrate comprising a semiconductor device against a wetted polishing surface under controlled temperature and pressure. Alternatively, the substrate can be held stationary against a rotating, wetted polishing surface, or both the substrate and polishing surface can be moving. The polishing surface may be larger or smaller than the substrate surface, although it is preferable to have a polishing surface larger than the substrate surface to prevent edge effects from the polishing surface acting upon the substrate. Typically the polishing surface is at least 4 inches in diameter, preferably at least 8 inches in diameter, and for specialized applications, the polishing surface may have a diameter as large as about 24 inches.

Figure 1:
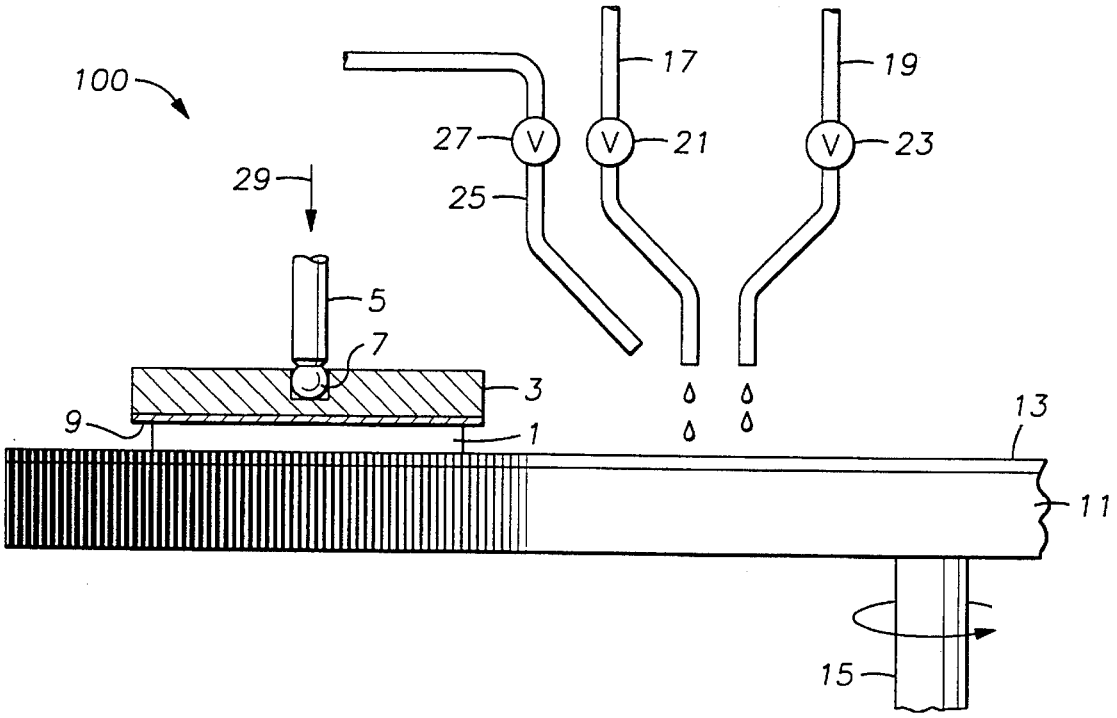
FIG. 1 (PRIOR ART)
FIG. 1 shows a schematic of a typical chemical-mechanical polishing apparatus.

Merely for exemplary purposes, FIG. 1 shows a conventional CMP device of the kind described in U.S. Pat. No. 3,979,239 to Walsh, issued Sep. 7, 1976. The CMP device 100, shows a semiconductor wafer 1 which is placed under a pressure block 3, which is carried by a freely rotatable spindle 5 which rotates about a pivot 7. A retention pad 9 for protection and for preventing slippage between the pressure block 3 and the wafer 1 is positioned between the wafer 1 and the block 3. Turntable 11 carrying a fixed polishing pad 13 is driven by a motor (not shown) about spindle 15. Thus, the turntable 11 and wafer 1 rotate in the same direction. The etching components and/or slurry are metered onto the polishing pad 13 through supply lines 17 and 19, for example. Valves 21 and 23 are used to control relative flow rates of etching components and/or slurry from lines 17 and 19, respectively. Rinse water can be supplied to the turntable 11 through line 25, flow being regulated by valve 27.

With respect to FIG. 1, preferably, during the polishing operation, a positive pressure is applied through the wafer 1 normal to the turntable 11, as indicated by arrow 29. The pressure may range from about 10 to about 100 pounds per square inch of wafer 1 surface area in contact with turntable 11. The temperature of the aqueous solution employed as well as temperature of the surrounding atmosphere can be controlled depending on criticality. Typically such temperature is maintained at about room temperature, i.e., about 20° C. to about 25° C., although higher temperatures may occur at higher polishing rates, depending on the heat transfer means used to remove the heat as it is generated.

Figure 2A:
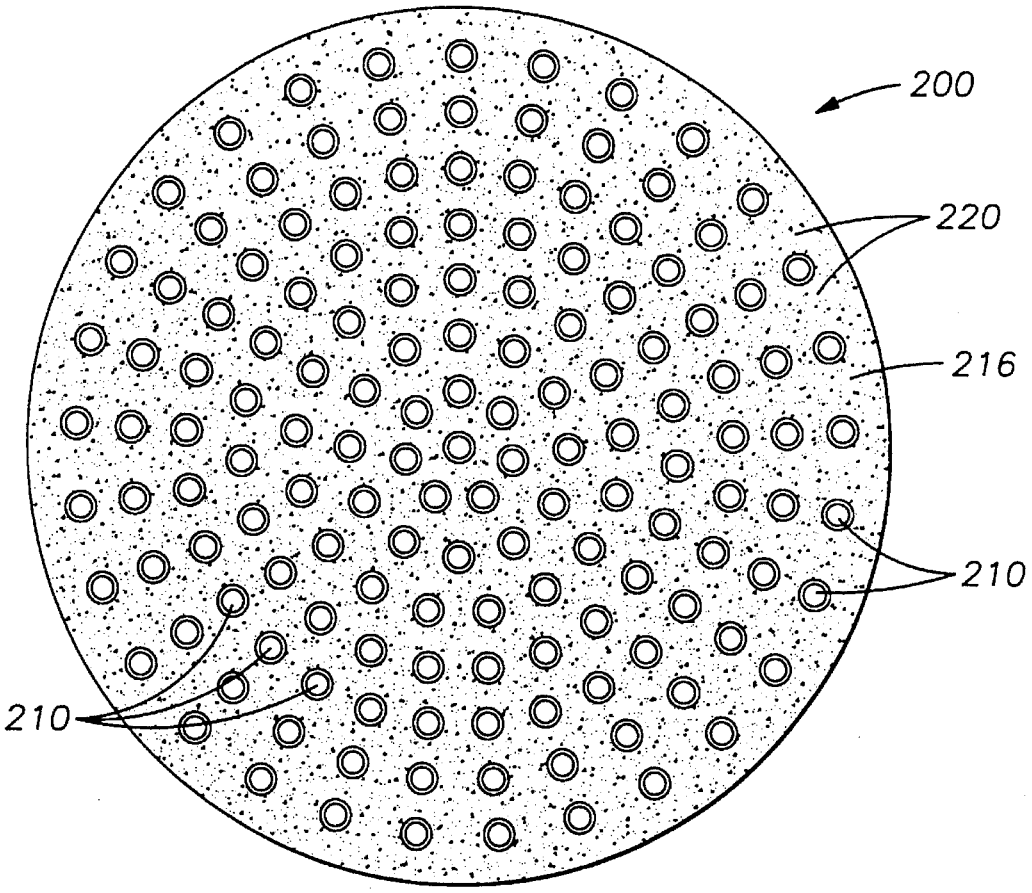
Figure 2B:
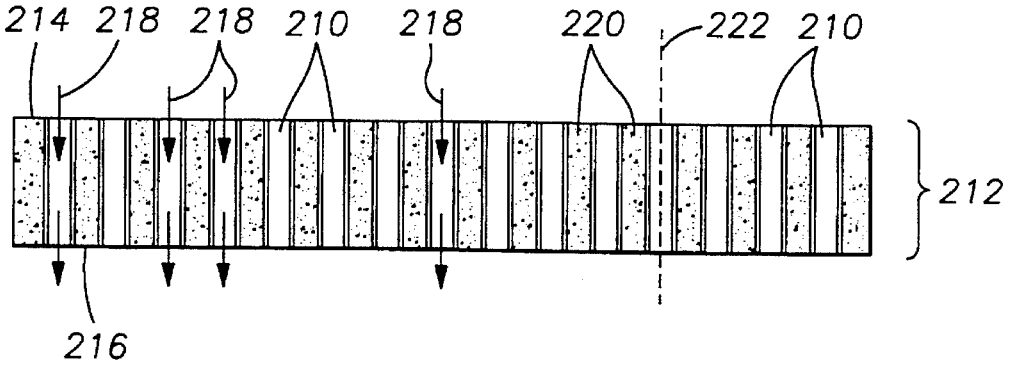
FIG. 2B is a schematic of the cross-section of the polishing pad of FIG. 2A.

In accordance with the present invention, a polishing pad is constructed to comprise a plurality of conduits, preferably tubular shaped, surrounded by a supporting matrix structure, as illustrated in FIG. 2. The conduits will be described below as tubulars, for purposes of discussion. As they are illustrated in FIG. 2, the conduits are tubulars which are constructed from a material which is different from the supporting matrix. With reference to FIG. 2, the polishing pad 200 comprises tubulars 210 which pass, preferably transversely or nearly transversely, entirely through the thickness 212 of the polishing pad 200, as shown in FIG. 2B. However, the polishing pad 200 may employ a tubular 210 which does not pass all of the way through the thickness 212 of pad 200, (not shown) but extends into pad 200 only for the distance which represents the portion of the pad which will be used as a polishing surface. The polishing pad 200 may be attached to a supporting structure designed to function in combination with the polishing pad to provide the desired results. In the instance when the tubulars do not pass all the way through the thickness 212 of polishing pad 200, and the pad basically provides a polishing surface over another support structure, the thickness of the polishing pad typically ranges from about 10 mils (0.25 mm) to about 500 mils (12.7 mm). In the most preferred embodiment, where tubulars 210 pass through the entire polishing pad thickness 212, such tubulars 210 can be used to feed an abrasive slurry, reactive etchant material, heat transfer medium (cooling fluid), lubricant, or a combination thereof represented by arrows 218, from a non-working surface (side) 214 of the polishing pad 200 to the working surface 216 of the polishing pad 200. In this instance the polishing pad thickness 212 is typically greater than the 10 mils (0.25 mm) described above, to provide structural stability.

Preferably the tubulars 210 are positioned within the surrounding matrix 220 so that they stand essentially erect, i.e. perpendicular to the planar working surface 216 of the polishing pad 200. The tubulars 210 may be positioned at an angle from the planar surface of the polishing pad, preferably the angle between the longitudinal centerline 222 of the tubular 210 and the working planar surface 216 of the polishing pad 200 ranges between about 60° and about 120°. This angle between the tubular 210 and the working surface 216 of the polishing pad 200 is used to achieve a polishing effect when the tubular 210 is constructed of a material having sufficient hardness to act as an abrasive in the polishing action and aids in prevention of clogging of the tubular 210 with slurry or reactive etchant 218 when the tubular 210 is used to feed slurry or reactive etchant 218 to the working surface 216 of the polishing pad 200.

The packing density of the tubulars 210 within the polishing pad 200 matrix is adjusted to provide for the fluid flow volume to the pad surface, to provide the desired amount of void space (pockets) for slurry or reactive etchant handling, and, depending on the relative degree of hardness of the tubular 210 material with respect to that of the supporting, surrounding matrix 220, to provide the overall abrasiveness desired for the polishing pad 200. Typically the portion of working surface 216 of pad 200 which is occupied by tubulars 210 ranges from about 20% to about 70% of the surface area. Preferably, the percentage of surface area occupied by tubulars ranges from about 35% to about 60% of polishing pad 200 surface area, with the remaining 65% to 40%, respectively, being matrix material 220. Most preferably the percentage of surface area occupied by tubulars 210 ranges between about 35% and about 50%. For a given percentage of pad surface area occupied by tubulars, the percentage of the polishing pad 200 which is void area (empty pocket in which slurry or reactive etchant can reside) depends on the wall thickness of the tubular 210. (In the case of a conduit having no lining, the void surface area would be the same as the conduit surface area.) The wall thickness can be viewed in terms of the tubular outside diameter (OD) and the tubular inside diameter (ID). The wall thickness (t) of the tubular is (OD–ID)/2. When t is approximately 10% of the OD (and the ratio of OD to ID is about 1.25), for example, the void area is approximately 64% of the area encompassed by the OD of the tubular. Therefore, when the ratio of OD to ID is about 1.25 and the percentage of the working surface 216 of polishing pad 200 which is occupied by tubular 210 ranges from about 20% to about 70%, the void area ranges from about 13% to about 45% of the working surface 216. The wall thickness, t, which is required depends on the strength of the material from which the tubular is constructed, the support received by the tubular surface from the matrix material which surrounds it, and the required pressure inside the tubular. In embodiments of the present invention when it is desired to feed a slurry through the tubular to the surface of the polishing pad and the pressure inside the tubular typically ranges between about 25 and 500 pounds per square inch (PSI) (about 1.75 to about 35 $kg/cm^2$). The support matrix preferably provides continuous support over the outside surface of the tubular, minimizing the wall thickness of the tubular required to handle a given internal pressure, so that the void area can be maximized. One skilled in the art can calculate the void surface area available for a given composite structure based on materials engineering data for the tubular and matrix materials and operating conditions for the polishing pad.

The diameter of the tubulars can vary, depending on the polishing action to be accomplished. Preferably the tubulars are of a sufficiently resilient material that they can return to their original position relative to the polishing pad surface after contact with the article to be polished. The materials of construction of the tubulars and tubular ID and wall thickness are discussed in additional detail below.

The conduits are preferably formed from an organic polymer-comprising material, although silicon-based polymers, graphite reinforced carbon, and ceramics can be used as well. The stiffness or rigidity of the conduit can be controlled by selection of the polymeric material from which the tubular is formed. Typical polymeric materials useful for construction of the conduits include polyester, acrylic, acrylic ester copolymers, poly tetrafluoroethylene, polypropylene, polyethylene, poly 4-methyl pentene, cellulose, cellulose esters, polyamides such as nylon and aramids, polyimides, polyimideamide, polysiloxane, and polysiloxane-POLYIMIDE copolymers, polycarbonates, epoxies, and phenolic, by way of example and not by way of limitation.

The polymeric materials can be filled with abrasive materials or reinforcing fibers if desired. The abrasive filler materials can be any of those typically used in CMP polishing slurries. Typical preferred additive particulate materials used to fill or reinforce the polymeric matrix materials include borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof. When increased abrasion is desired, preferred additive particulate materials include borosilicate glass, diamond, silicon carbide, silicon nitride, and graphite, for example.

The conduits can be formed directly from harder, more rigid materials such as borosilicate glasses, silicon carbide or ceramic (in the form of nitrides and carbides), if desired. Hollow fibers of these materials are commercially available. However, conduits formed solely from these more rigid materials can cause scratching of a soft substrate surface, and typically the organic polymer materials previously discussed for conduit formation are preferred.

With reference to the conduits, in terms of a tubular, for example, the inside diameter (ID) of the tubulars can be varied as necessary to accommodate particle sizes of the abrasive slurry and reactive etchant material, to accommodate pressure within the tubular, and to control the abrasion contribution from the tubulars. For example, typical particle sizes within polishing slurries vary from about 0.08 micrometer (μm) to about 80 μm, with about 0.08 μm to about 10 μm being preferred. With this in mind, it is recommended that the ID of the tubular range from about 0.2 μm to about 1,000 μm. An increase in tubular wall thickness generally results in a stiffer tubular, a tubular which can accommodate increased internal pressure, and a tubular which can provide availability of abrasive particulates when the tubular is constructed from a source of particulate-generating material. However, as previously described, the void area (which can act as a pocket for storage and handling of a slurry) available for a given tubular decreases with an increase in tubular wall thickness. In instances where the tubular is used to feed only a heat transfer fluid or a lubricant to the polishing surface of the polishing pad, and the source of the abrasive or reactive etchant is the tubular itself and/or the matrix material surrounding the tubular, the void area becomes less critical. In general, recommended wall thicknesses for tubulars are such that the ratio of OD to ID of the tubular ranges from about 1.1 to about 8.0, preferably from about 1.1 to about 4.0, and most preferably from about 1.1 to about 2.0. The tubulars are formed using extrusion or casting techniques known in the art.

The matrix supporting/surrounding the tubulars is preferably formed from a material of similar hardness, but more porous than that used to form the tubulars. The more preferred matrix materials include polyurethanes, isocyanate-capped polyoxyethylene polyols, polyesters, vinyl esters, epoxies and rubber-modified epoxies, acrylics, acrylic ester copolymers, butadiene styrene copolymers, uncured nitrile rubber, silastics, polyether ether ketone, polytetrafluoroethylene, polypropylene, polyethylene, polyamides, polyimides, and phenolics, by way of example and not by limitation. As previously described, a polymeric matrix materials can also be filled or reinforced with various additive materials to lengthen the lifetime of the polishing pad itself and/or to provide an abrasive contact surface. When the additive particulate material is to be used to provide an abrasive contact for polishing of a substrate, i.e. wafer, surface, the grain size of the polishing particles is preferably less than 0.05 μm, and more preferably less than 0.02 μm.

One preferred method of fabrication the polishing pad is pultrusion, where the tubulars are pulled through a resin bath to apply a coating of resin and then through a series of dies in which the resin is cured to provide a support matrix around the tubulars. The composite of tubulars and surrounding matrix, which would typically be cylindrical in form with the tubulars perpendicular to the end faces of the cylinder, is then sliced into polishing pads of the desired thickness. A second method of forming the polishing pad is a method useful in forming conduits through the entire thickness of the polishing pad matrix material, where the conduit can be merely an opening through the polishing pad (and there is no conduit material distinct from the matrix material) or the conduit can be a distinct material which forms a lining on the surface of the matrix material. The matrix material is cast or injection molded into a mold which has fibers or hollow fibers in place within the mold at the position in which an opening through the polishing pad matrix is desired. After the matrix has been cast or molded, the fibers are removed to create the openings through the matrix or the hollow fibers are left in place to provide a conduit lining within the matrix material.

The two methods described above are described in further detail below as preferred embodiments for purposes of illustration. Although the preferred embodiments in themselves may contain novel steps or compositional elements, they are not intended to be limiting of the scope of the fabrication method, as one skilled in the art after reading the description of these embodiments can envision various modifications of the techniques which can provide the kind of polishing pad described and claimed herein.

Pultrusion is a technique for forming composite structures which was developed in the early 1980's. Continuous fiber reinforcement, typically in the form of roving or mat/roving is drawn through a resin bath to coat each fiber with a specially formulated resin mixture. The coated fibers are assembled by a forming guide and then drawn through a heated die. Typically the resin is a thermosetting resin which is thermoset by heat in the die and catalyst in the resin mix. The rate of reaction is controlled by controlling the amount of time the fibers are in the coating bath and by controlling heating and cooling zones in the die. In the present instance, tubulars (with or without a fiber support in the center of the tubular) are coated with a resin by passing them through a resin bath and are brought together into a die which is vibrated to align the tubulars. Once the tubulars are aligned, they are gradually pulled through a die or series of dies in which the resin coating is cured to provide a supporting matrix surrounding the tubulars. The temperature at which the resin coating is cured must be controlled to be lower than the melting temperature of the tubular. The tubulars are typically pulled through the die between two caterpillar-type pull block belts which are constructed from a high temperature silicone rubber or an equivalent. After exiting the pulling belts, the composite polishing pad pultrusion is cut using a cut-off saw to produce a polishing pad of the desired thickness. The composite polishing pad pultrusion can be cut perpendicular to the longitudinal direction of movement of the tubules when it is desired to have tubulars perpendicular to the working surface of the polishing pad. The composite polishing pad pultrusion can be cut at an angle greater than or less than 90 degrees to the longitudinal direction of movement of the tubulars to produce a polishing pad having the tubulars at a particular angle relative to the working surface of the polishing pad. A more detailed description of the pultrusion process can be obtained from PTI division of MMFG (Morrison Molded Fiber Glass Company) of Bristol, Va.

Figure 3A:
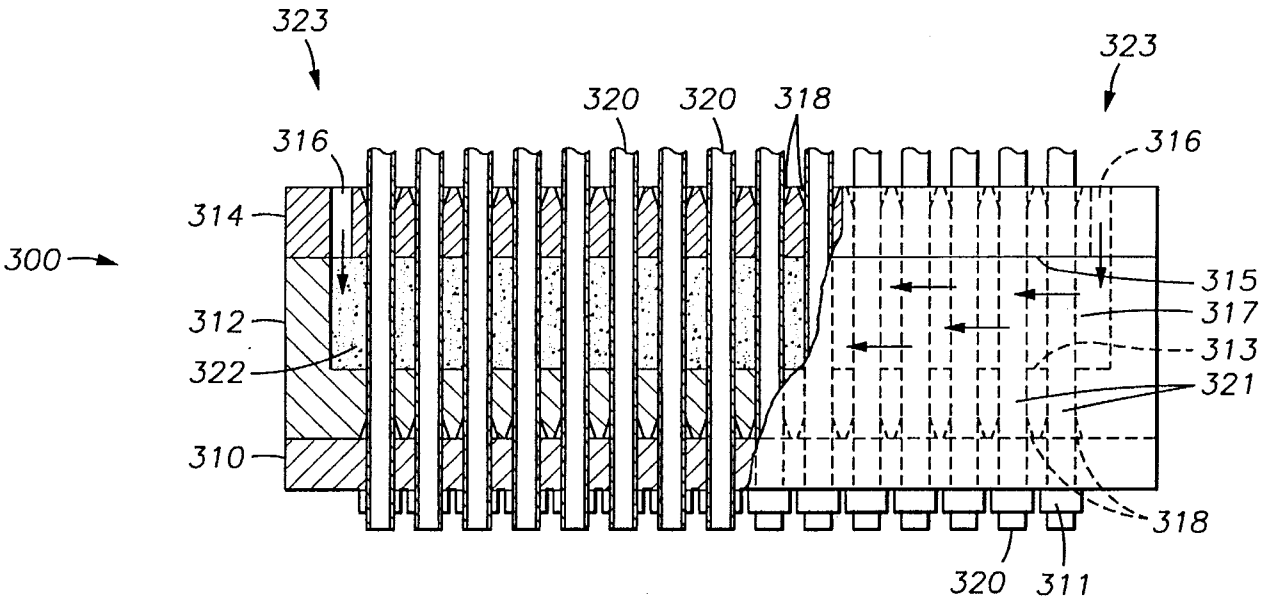
FIG. 3A shows a schematic of a side view through a mold which can be used for fabrication of a polishing pad having conduits which extend entirely through the thickness of the polishing pad.
Figure 3B:
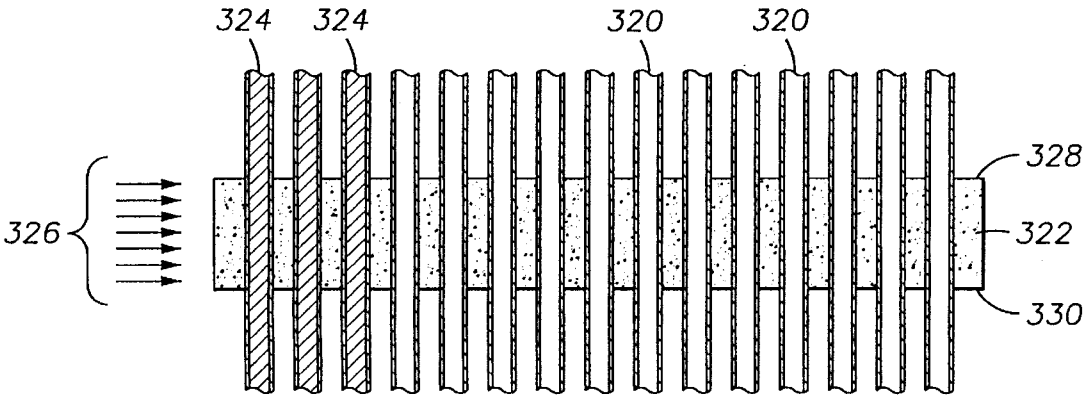
FIG. 3B illustrates a schematic of a cross-sectional view of an unfinished polishing pad fabricated using the mold shown in FIG. 3A.

FIG. 3A illustrates a preferred embodiment for the casting or injection molding of a polishing pad of the kind shown in FIG. 3B, which comprises hollow fibers or tubulars within a support matrix. The casting or injection mold 300 is comprised of 3 major sections: a bottom plate 310 which serves to lock the tubulars in place; a lower mold section 312 which guides the tubulars into the casting chamber 317, the upper surface 313 of lower mold section 312 forming one major casting surface for the polishing pad matrix material; and, an upper mold section 314 which guides the tubulars through the upper portion of the mold and provides surface 315 which acts as the second major casting surface for the polishing pad matrix material.

Bottom plate 310 includes holding fixtures 311 through which tubulars 320 are inserted and locked into place. Lower mold section 312 includes funnel-shaped openings 318 which guide the tubulars into aligning openings 321 which position the tubulars 320 within the casting chamber 317. Upper mold section 314 includes funnel-shaped openings 318 which permit easy exit of tubulars 320 from casting or injection mold 300. Matrix material 322 enters mold 300 through openings 316 which can be located at various positions relative to casting chamber 317, as necessary to permit flow of matrix material 322 into casting chamber 317. More openings 316 for the feed of matrix material 322 into mold 300 will be required when the matrix material 322 is more viscous and the polishing pad has a larger diameter. A vacuum assist (not shown) may be used to facilitate flow of matrix material 322 into casting chamber 317. The flow of matrix material 322 into mold 300 is represented by arrows 323.

Matrix material 322 is cured (thermoset) or cooled (thermoplastic) within casting chamber 317 to produce a solid matrix material 322 surrounding tubulars 320. The casting or injection mold 300 may be heated or cooled using equipment (not shown) and techniques known in the molding art.

In a less preferred embodiment of the present invention, it is desired to have a matrix material with conduits entirely through its thickness and with no liner material other than the matrix material around the conduits. In that instance, after cure or cooling of the matrix material 322, the bottom plate 310 of mold 300 is pulled away from lower mold section 312, pulling tubulars 320 out of the matrix material 322, leaving an opening (not shown) where the tubulars 320 had been. Upper mold section 314 and lower mold section 312 are then removed to provide a cast or molded matrix material 322 either having the desired polishing pad dimensions or from which the desired polishing pad dimensions can be machined. To facilitate removal of the tubulars 320 (or solid fibers), such tubulars or fibers are fabricated from a non-stick material, such as a fluorinated hydrocarbon, which is easily released from matrix material 322. In an alternative means of fabrication, tubular (or fiber if preferred) 320 is fabricated from a material which is soluble in a solvent which essentially does not affect matrix material 322. After cure or cooling of matrix material 322, tubulars 320 are released from holding fixtures 311, and bottom plate 310 is pulled away from lower mold section 312, leaving tubulars 320 within matrix material 322. Subsequently, upper mold section 314 and lower mold section 312 are removed and the cast or molded matrix is treated with a solvent to dissolve away tubulars 320 without affecting matrix material 322.

When it is desired to have a conduit liner material different from the matrix material, tubulars 320 are used to provide the liner material. The tubulars 320 are fabricated from the desired liner material, and are left in place within matrix material 322. After cure or cooling of matrix material 322, tubulars 320 are released from holding fixtures 311, and bottom plate 310 is pulled away from lower mold section 312, leaving tubulars 320 within matrix material 322. Upper mold section 314 and lower mold section 312 are then removed, as described above, to provide a cast or molded matrix material either having the desired polishing pad dimensions or from which the desired polishing pad dimensions can be machined. FIG. 3B illustrates a side view through the matrix material 322, with tubulars 320 in place after removal of casting or injection mold 300. The molded matrix material 322, with tubulars 320 in place can then be sliced, as indicated by arrows 326 to provide a number of polishing pads, if desired. It may be preferable to slice the molded matrix material 322 prior to complete cure, in which case the molded matrix material 322 would be removed from mold 320 prior to complete cure, sliced, and then post cured in an oven to provide a complete cure of matrix material 322. When each molded part is to act as a single polishing pad, it is necessary to grind off, cut off, or burn off upper surface 328 and lower surface 330 of the cast polishing pad to remove excess tubular material remaining at the surfaces 328 and 330 of matrix material 322. In instances where the matrix 322 molding process will place high pressures on tubulars 320 during molding, it may be desirable to have tubulars 320 filled with a solid material 324 which can subsequently be dissolved away after the molding process.

In the most preferred embodiment of the present invention, the conduits which extend entirely through the polishing pad are used to transport a fluid from the nonworking side of the polishing pad. As previously described, this fluid can be an abrasive-containing slurry, a reactive etchant, a heat transfer medium, a lubricant, or a combination thereof. For example, an abrasive-containing slurry can also include carbon dioxide, which works as a scrubber to keep the conduit open and clean and to facilitate in the chemical-mechanical polishing itself. (It is also possible to feed one fluid, such as the abrasive-containing slurry to a portion of the conduits, while feeding another fluid, such as a cooling lubricant to a different portion of the conduits, although this adds complexity to the fluid feeding system.) The material used to construct the matrix material (when no conduit liner is present) or the tubular used to line the conduit must be selected to be chemically compatible with the slurry, reactive etchants and other fluids to be passed through the conduit. The chemical-mechanical polishing can be carried out under acidic or basic conditions, making the conduit liner selection important. One skilled in the art looking at the engineering data for the various materials which can be used to fabricate the matrix material and/or the conduit liner, can select the materials compatible with the chemical-mechanical polishing process to be carried out. The polishing pads may be color coded to identify the chemical compatibility of the pad, so that the user can easily select from his inventory the pad which is compatible with the process he is using that day.

With reference to FIG. 2, in the most preferred embodiment of the present invention, the conduit, tubular 210 passes through the entire thickness 212 of the polishing pad 200, as shown in FIG. 2B. This permits a polishing slurry or reactive etchant material to be fed from the nonworking surface 214 of polishing pad 200 through tubulars 210 to the working surface 216 of polishing pad 200. The tubular should permit the polishing slurry or reactive etchant material to flow easily through the tubular without becoming attached to the tubular wall: i.e., the tubular wall preferably has a smooth, non-reactive (to the slurry or etchant) surface. The polishing slurry or etchant material 218 is forced through tubulars 210 using a pressure (typically ranging between 50 and 1,000 psi and preferably between 50 and 500 psi) which depends on the viscosity of the slurry or etchant material 218, the ID of the tubular, and the desired flow rate of slurry or etchant onto the working surface 216 of polishing pad 200. A constant flow of slurry or etchant material 218 helps prevent clogging of tubulars 210. Should clogging occur, an inert gas or a liquid such as water can be forced through tubulars 210 to remove the undesired build up.

U.S. Pat. No. 5,205,082 to Shendon et al., issued Apr. 27, 1993, describes a polishing head useful in semiconductor wafer polishing. The polishing head enables a wafer supporting structure (retainer) to float during polishing and yet extend beyond the wafer carrier. The head uses positive air pressure to press the wafer against the polishing pad. A similar polishing head can be used to support the polishing pad of the present invention in a manner which permits the pad to float while extending past the pad carrier. In the present instance, the floating pressure is provided by a reservoir (not shown) of a fluid which is pressurized slurry, reactive etchant material, heat transfer fluid, lubricant, or a combination thereof, which is in contact with the nonworking surface 214 of polishing pad 200 and supplies slurry, reactive etchant material, heat transfer fluid, lubricant, or a combination thereof 218 to conduits (preferably tubulars) 210 to feed fluid material 218 to the working surface 216 of polishing pad 200. Shendon describes a preferred polishing head in U.S. patent application Ser. No. 08/205,276, filed Mar. 2, 1994, which is hereby incorporated in its entirety by reference.

The above-described preferred embodiments are provided to illustrate the invention and are not intended to limit the scope of the invention, as one skilled in the art, by substituting materials of construction and by varying dimensional parameters, can extend the invention to the scope of the claims which follow.

I claim:

1. A structure useful as a polishing pad for chemical-mechanical polishing, comprising:

(a) a plurality of conduits; and (b) a matrix of material in contact with and supporting said conduits and shaped to form a polishing pad;

wherein, said conduits are constructed from a first material which is different from a second material used as said support matrix, wherein said conduits are positioned within said support matrix in a manner such that longitudinal centerlines of said conduits form an angle principally ranging from about 60° to about 120° with the working surface of said polishing pad.

2. The structure of claim 1, wherein said conduits comprise from about 10% to about 50% of the total surface area of said polishing pad.

3. The structure of claim 2, wherein said conduits are more heavily concentrated toward the outer edges of said polishing pad.

4. The structure of claim 2, wherein said conduits are more heavily concentrated toward the center of said polishing pad.

5. The structure of claim 2, wherein said conduit is a tubular.

6. The structure of claim 5, wherein the ratio of said tubular outer diameter to said tubular inner diameter ranges from about 1.1 to about 8.0.

7. The structure of claim 1, wherein said conduit comprises an organic polymer or a silicon-based polymer.

8. The structure of claim 2, wherein said conduit comprises an organic polymer or a silicon-based polymer.

9. The structure of claim 5, wherein said tubular comprises an organic polymer or a silicon-based polymer.

10. The structure of claim 6, wherein said tubular comprises an organic polymer or a silicon-based polymer.

11. The structure of claim 1, wherein said conduit comprises an organic or silicon-based polymer selected from the group consisting of polyester, acrylic, acrylic ester copolymers, poly tetrafluoroethylene, polypropylene, polyethylene, poly 4-methyl pentene, cellulose, cellulose esters, polyamides such as nylon and aramids, polyimides, polyimideamide, polysiloxane, and polysiloxane-POLYIMIDE copolymers, polycarbonates, epoxies, and phenolic.

12. The structure of claim 1, wherein less than 50% of said conduit consists of a material selected from borosilicate glasses, carbons including graphite, and ceramics in the form of nitrides and carbides.

13. The structure of claim 2, wherein said conduit comprises an organic or silicon-based polymer selected from the group consisting of polyester, acrylic, acrylic ester copolymers, poly tetrafluoroethylene, polypropylene, polyethylene, poly 4-methyl pentene, cellulose, cellulose esters, polyamides such as nylon and aramids, polyimides, polyimideamide, polysiloxane, and polysiloxane-POLYIMIDE copolymers, polycarbonates, epoxies, and phenolic.

14. The structure of claim 9, wherein said organic polymer or silicon-based polymer is selected from the group consisting of polyester, acrylic, acrylic ester copolymers, poly tetrafluoroethylene, polypropylene, polyethylene, poly 4-methyl pentene, cellulose, cellulose esters, polyamides such as nylon and aramids, polyimides, polyimideamide, polysiloxane, and polysiloxane-POLYIMIDE copolymers, polycarbonates, epoxies, and phenolic.

15. The structure of claim 10, wherein said organic polymer or silicon-based polymer is selected from the group consisting of polyester, acrylic, acrylic ester copolymers, poly tetrafluoroethylene, polypropylene, polyethylene, poly 4-methyl pentene, cellulose, cellulose esters, polyamides such as nylon and aramids, polyimides, polyimideamide, polysiloxane, and polysiloxane-POLYIMIDE copolymers, polycarbonates, epoxies, and phenolic.

16. The structure of claim 11, wherein said organic or silicon-based polymer is filled with an abrasive particle or a fibrous reinforcement.

17. The structure of claim 13, wherein said organic or silicon-based polymer is filled with an abrasive particle or a fibrous reinforcement.

18. The structure of claim 14, wherein said organic or silicon-based polymer is filled with an abrasive particle or a fibrous reinforcement.

19. The structure of claim 15, wherein said organic or silicon-based polymer is filled with an abrasive particle or a fibrous reinforcement.

20. The structure of claim 16, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

21. The structure of claim 17, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

22. The structure of claim 18, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

23. The structure of claim 19, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

24. The structure of claim 1, wherein said matrix material comprises an organic polymer or a silicon-based polymer.

25. The structure of claim 2, wherein said matrix material comprises an organic polymer or a silicon-based polymer.

26. The structure of claim 5, wherein said matrix material comprises an organic polymer or a silicon-based polymer.

27. The structure of claim 6, wherein said matrix material comprises an organic polymer or a silicon-based polymer.

28. The structure of claim 24, wherein said organic or silicon-based polymer is selected from the group consisting of polyurethanes, isocyanate-capped polyoxyethylene polyols, polyesters, vinyl esters, epoxies and rubber-modified epoxies, acrylics, acrylic ester copolymers, butadiene styrene copolymers, uncured nitrile rubber, silastics, polyether ether ketone, polytetrafluoroethylene, polypropylene, polyethylene, polyamides, polyimides, and phenolics.

29. The structure of claim 25, wherein said organic or silicon-based polymer is selected from the group consisting of polyurethanes, isocyanate-capped polyoxyethylene polyols, polyesters, vinyl esters, epoxies and rubber-modified epoxies, acrylics, acrylic ester copolymers, butadiene styrene copolymers, uncured nitrile rubber, silastics, polyether ether ketone, polytetrafluoroethylene, polypropylene, polyethylene, polyamides, polyimides, and phenolics.

30. The structure of claim 26, wherein said organic or silicon-based polymer is selected from the group consisting of polyurethanes, isocyanate-capped polyoxyethylene polyols, polyesters, vinyl esters, epoxies and rubber-modified epoxies, acrylics, acrylic ester copolymers, butadiene styrene copolymers, uncured nitrile rubber, silastics, polyether ether ketone, polytetrafluoroethylene, polypropylene, polyethylene, polyamides, polyimides, and phenolics.

31. The structure of claim 27, wherein said organic or silicon-based polymer is selected from the group consisting of polyurethanes, isocyanate-capped polyoxyethylene polyols, polyesters, vinyl esters, epoxies and rubber-modified epoxies, acrylics, acrylic ester copolymers, butadiene styrene copolymers, uncured nitrile rubber, silastics, polyether ether ketone, polytetrafluoroethylene, polypropylene, polyethylene, polyamides, polyimides, and phenolics.

32. The structure of claim 24, wherein said organic or silicon-based polymer is filled with an abrasive particle or a fibrous reinforcement.

33. The structure of claim 25, wherein said organic or silicon-based polymer is filled with an abrasive particle or a fibrous reinforcement.

34. The structure of claim 26, wherein said organic or silicon-based polymer is filled with an abrasive particle or a fibrous reinforcement.

35. The structure of claim 27, wherein said organic or silicon-based polymer is filled with an abrasive particle or a fibrous reinforcement.

36. The structure of claim 32, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

37. The structure of claim 33, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

38. The structure of claim 34, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

39. The structure of claim 35, wherein said abrasive particle is selected from the group consisting of borosilicate glass, titanium dioxide, titanium nitride, aluminum oxide, aluminum trioxide, iron nitrate, cerium oxide, zirconium oxide, ferric oxide, tin oxide, chromium oxide, silicon dioxide (colloidal silica preferred), silicon nitride, and silicon carbide, graphite, diamond, and mixtures thereof.

40. The structure of claim 1, wherein said conduit does not extend through the entire thickness of said polishing pad.

41. The structure of claim 1, wherein said conduit does extend through the entire thickness of said polishing pad.

42. A method of polishing a semiconductor-comprising substrate surface, comprising:

(a) providing said substrate to be polished; and (b) using the structure of claim 1 to polish said substrate surface.

43. The method of claim 42, wherein a fluid selected from the group consisting of abrasive slurry, reactive etchant material, heat transfer medium, lubricant, and combinations thereof is forced from the non-working surface of said polishing pad to the working surface of said polishing pad, whereby said substrate surface is polished.

* * * * *